US006123594A

United States Patent [19]

Masse

[11] Patent Number: 6,123,594

[45] Date of Patent: Sep. 26, 2000

[54] SHORT MOTION SWIM FIN

[76] Inventor: E. Roger Masse, 340 Washington St., Tappan, N.Y. 10983

[21] Appl. No.: 09/354,437

[22] Filed: Jul. 16, 1999

[51] Int. Cl.[7] ..... A63B 31/10

[52] U.S. Cl. ..... 441/64

[58] Field of Search ..... D21/806; 441/61–64

[56] References Cited

U.S. PATENT DOCUMENTS 1,374,077 4/1921 Grundmann ..... 441/64

3,302,223 2/1967 Ciccotelli ..... 441/64

4,209,866 7/1980 Loeffler ..... 441/64

*Primary Examiner*—Ed Swinehart

*Attorney, Agent, or Firm*—Richard A. Joel, ESQ

[57] ABSTRACT

A short motion swim fin used as a training device for the improvement of the fast flutter kick motions of speed swimming, and as such uses a short, rigid frame, that is worn on the underside of the forward portion of the foot where it functions as a lever to stretch the arch of the entire foot on every downward kick, as well as to strengthen the fast twitch leg muscles associated with a strong flutter kick.

10 Claims, 4 Drawing Sheets

SHORT MOTION SWIM FIN

CROSS-REFERENCE TO RELATED APPLICATIONS (NOT APPLICABLE)

STATEMENT REGARDING FEDERALLY SPONSERED RESEARCH OR DEVELOPMENT (NOT APPLICABLE)

REFERENCE TO A MICROFICHE APPENDIX (NOT APPLICABLE)

BACKGROUND OF THE INVENTION

My invention is a short motion swim fin that functions as a stretching device to stretch and increase the arch of the foot, and as a training device to strengthen the leg muscles that are used with the motions of the flutter kick.

My invention differs in design, function, and mechanics from all prior art seen relating to swim fins, wherein it is a training device for the competitive swimmer; and not designed or intended as a more efficient propulsion device.

My invention is a training swim fin that when used over time will improve a swimmer's performance for competitive swimming without the fins.

My invention is intended and designed specifically for use with the flutter kick, which is a short, fast motion kick, used for the front or back crawl whereby the body is parallel to the surface of the water with the legs moving up and down from the hips, in short, fast motions, knees slightly bending, and the feet kept loose. The extent of flexible arching of the feet is the critical element for converting the leg motion into propulsion by presenting an angle of attack from the loosely arching foot on every downward kick. The downward kick is the power portion of the flutter kick, whereas the upward motion is more for balance and recovery. The loosely arching foot functions, if you will, as a propeller blade. In fact many swimmers have a flutter kick that defines a spiral wake as a result of a well-defined arch. Although my swim fins produce an impressive increase in propulsion, they do so as a result of a short, fast, kicking motion, and accordingly are not designed or intended to conserve energy.

Whereas the relevant art studied discloses swim fins that are, for the most part, designed to function for underwater diving. And as such function for the purpose of propulsion efficiency in order to conserve energy, and they do so by using a common principle whereby the fin, in one form or another, is worn as a flexible extension of the foot so that the fin itself presents a greater surface, and angle of attack, against the water. This principle is well suited where conservation of energy, or air supply, is the primary consideration; but these fins also require a slower, longer kicking motion, or if you will, comparable to using a large gear for power to a smaller gear for speed. And accordingly, these fins are not practical for the short, fast kicking motions of the flutter kick, or more specifically, as a training device for competitive swimming without fins.

In addition to the originality for use of my invention, there is also originality in the design and mechanics. Specifically, it is a short fin that has a rigid U shape frame, that when worn on the forward portion of the foot acts as a lever to the foot with the fulcrum of that lever being on the underside of the foot. The effect of this lever action stretches the arch of the foot on every downward kick.

None of the prior art seen can be practically used, or is disclosed to be used, in a similar way as my invention, specifically, as a stretching and training fin for the competitive swimmer, and in particular for the short motions of the flutter kick used in competitive swimming.

None of the prior art seen employ the same mechanics, or make any similar claims of the mechanics, from a swim fin with a rigid frame to lever the arch of the foot.

Whereas all the prior art seen have as a common objective to be used in a dynamic fashion for moving a swimmer through the water more efficiently.

The following U.S. patents are considered most relevant to my disclosure:

| U.S. Pat. No. | Inventor | Issue Date |
|---|---|---|
| 5,597,336 | Evans | Jan. 28, 1997 |
| 5,552,748 | Cressi | Jun. 4, 1996 |
| 3,789,448 | Mitchell | Feb. 5, 1974 |
| 2,556,894 | Axiotes | Jun. 12, 1951 |

The following U.S. patents are included as being of interest:

| | | |
|---|---|---|
| 5,683,279 | Raasch et. al. | Nov. 4, 1997 |
| 3,302,223 | Ciccotelli | Feb. 7, 1967 |
| 1,674,801 | Schwalge | Jun, 26, 1928 |
| 3,922,740 | Potter | Dec. 2, 1975 |
| 2,672,629 | Trell | Mar. 23, 195 |

A profile of each of these patents is as follows:

U.S. Pat. No. 5,597,336

Has an open instep, with planar heel, so as to accommodate a plurality of foot sizes and simplification of a single, two parts, molding process.

It is designed as a propulsion enhancement device with an elongated, flexible blade that has stiffening ribs under the foot, along the longitudinal axis of the fin, and also features unique protuberances to further reduce drag upon the blade surface.

U.S. Pat. No. 5,522,748

Is a three-part swim fm that has all the parts joined along the bottom of the shoe.

A full shoe attached to a forked, arcuate part that holds an elongated fin. And this arrangement is primarily intended to reduce the costs of production as compared to that of molded rubber fins.

And a flipper for enhancing propulsion, wherein the fin has an elongated, flexible, obtuse angle to the shoe, or bottom of the foot.

U.S. Pat. No. 3,789,448

A swimming aid for hand and foot propulsion that works on foot propulsion by using the legs in a pedaling, or climbing motion, whereby its design causes a stronger push against the water on the backward motion than it does on the forward motion.

U.S. Pat. No. 2,556,894

A swimming device for hand and foot propulsion that works on foot propulsion by using the legs in a pedaling, or climbing motion, whereby the device is kept in a perpendicular attitude to the leg on the backward motion to push against the water, and straightened, or feathered, on the forward motion for less resistance.

U.S. Pat. No. 5,683,279

Is a multi-part diving fin designed for propulsion enhancement with a pivotal footplate that engages the blade, or fin portion, in a manner that allows for adjusting the tension of the elongated blade according to the swimmer's ability.

This fin also has an alternate embodiment to accommodate diving boots.

U.S. Pat. No. 3,302,223

Is a swim fin comprising a full boot with a rigid, flat sole plate that hinges a U shape element, holding a flexible web, as the fin portion. The swimming motion of the leg causes the frame to move up and down independently from the motion or position of the boot, and in a manner that is a tensioned cantilever, so arranged as to present a greater angle of attack to the water on the downward motion than on the upward motion.

This swim fin is designed to enhance propulsion with minimal strain to the foot.

U.S. Pat. No. 1,674,801

Is a swimming appliance that is used with a pedaling or climbing motion whereby the pushing direction offers more resistance to the water than the pulling direction resulting in horizontal or vertical propulsion.

This swimming appliance also features a reinforced sole that is suitable for limited walking out of the water.

U.S. Pat. No. 3,922,740

This is a hand paddle and not applicable for wearing on the foot.

U.S. Pat. No. 2,672,629

Is a swimmer's propulsion aid that is used with a pedaling or climbing motion whereby the pushing direction offers more resistance to the water than the pulling direction resulting in a horizontal or vertical propulsion.

BRIEF SUMMARY OF THE INVENTION

It is a general object of my invention to provide effective training swim fins for the competitive swimmer to use in swimming workouts to improve upon the propulsion efficiency of his or her flutter kick in competition, or when not using swim fins.

It is a specific object of my invention to provide rigid, short motion, swim fins that are worn on the forward portion of the feet, so as to arch the entire foot including all joints distal to the ankle.

It is another specific object of my invention to provide swim fins of a calculated small size, with a rigid frame that will not bend or flex; but rather function as a lever to stretch the arch of the foot, so that the foot itself provides the angle of attack. So in effect, the mechanics of the invention causes the foot to flex by the force of the water against the fin with every downward motion of the flutter kick.

It is another specific object of my invention to provide rigid, short motion swim fins, that are small enough to allow a fast motion, but in a manner that requires the flexing motions of the entire foot, and as such also involves and strengthens those corresponding fast twitch leg muscles.

It is another object of my invention to provide a pair of swim fins that are both the same and therefor interchangeable to either foot, and with one size to fit most foot sizes.

It is another object of my invention to provide attachment components that make possible two different attachment methods to the foot of the swimmer for a choice of comfort level.

BRIEF DESCRIPTION OF THE SEVERAL VIEWS OF THE INVENTION

FIG. 1/9 is a top exploded view that is slightly perspective longitudinally of the three components that make up the body of the swim fin, whereby the same view is seen from the opposite, or underside. And accordingly, the surfaces, and edge lines, use the same numbers and may be distinguished as top, underside, or in the plural when referring to both sides, according to the description of the invention.

FIG. 2/9 is a progression of FIG. 1 showing two of the components assembled with the addition of a side view of the partial assembly of the swim fin body, according to the description of the invention.

FIG. 3/9 is a further progression of FIG. 2 showing all three components assembled to make up the body of the swim fin, according to the description of the invention.

FIG. 4/9 is a top perspective view of the three foot attachment components as attached to the assembled swim fin body, according to the description of the invention.

FIG. 5/9 shows the foot inserted into the swim fm with the securing components in place around the foot, according to the description of the invention.

FIG. 6/9 shows an alternate method of using the securing components around the foot, according to the description of the invention.

FIG. 7/9 is a top perspective view of the foot bone structure as positioned upon the swim fin to describe the mechanics of the swim fins, according to the invention.

FIG. 8/9 is a side view of the motion mechanics of the swim fins on the feet, according to the description of the invention.

FIG. 9/9 is another side view for describing the results of the swim fm mechanics according to the invention.

DETAILED DESCRIPTION OF THE INVENTION

Figure 1:
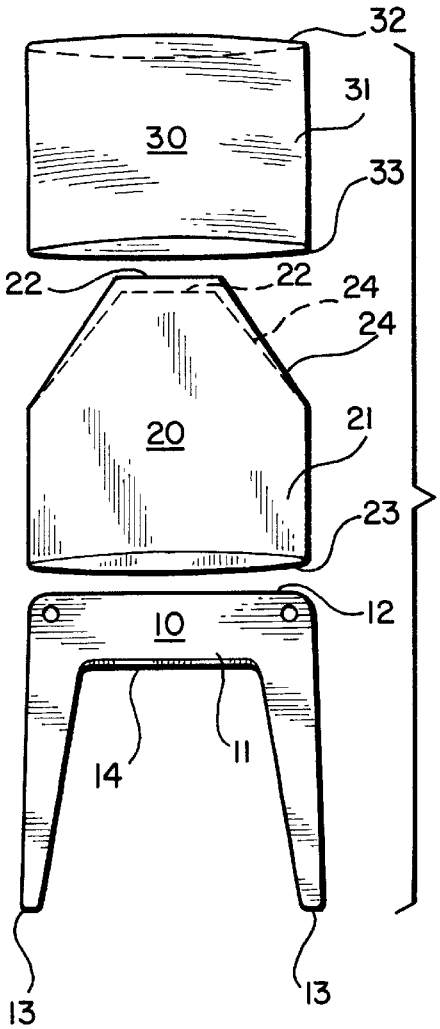

In FIG. 1/9 the three components of the fin body are shown disassembled and are designated as the U frame 10, the inside sleeve 20, and the outside sleeve 30.

The U frame 10 is a machine cut piece from a flat, polypropylene plastic sheet. This material is selected primarily because of low cost and relatively good rigidity with memory to retain its straightness. There are more expensive materials such as plastic composites that offer even better characteristics, particularly with regard to the ratio of rigidity to thickness, as well as producing the piece more efficiently by injection molding. But these are considerations dependent upon market demand.

The closed end of the U frame 10 is called the cross-member 11, or cross member surface 11, and is defined by one width along line 12, and another width along line 14. The opposite width is between the outside points 13, called the fork ends, and which define the greater width.

The inside sleeve 20, and the outside sleeve 30, are cut lengths from an extrusion of tubular synthetic rubber, of a width and thickness that provides an overall ideal tension and resiliency for their functions, and can be in a variety of colors.

The inside sleeve 20 has its surface 21 defined by the cut edges 22,23 and 24. And whereby it started as a four-sided rectangle, the two cuts along lines 24 form six sides, with the upper portion as a diagonal shape with two flaps.

The outside sleeve 30 is a rectangular shape, and has its surface 31 defined by the cut edges 32 & 33, along its width.

Figure 2:
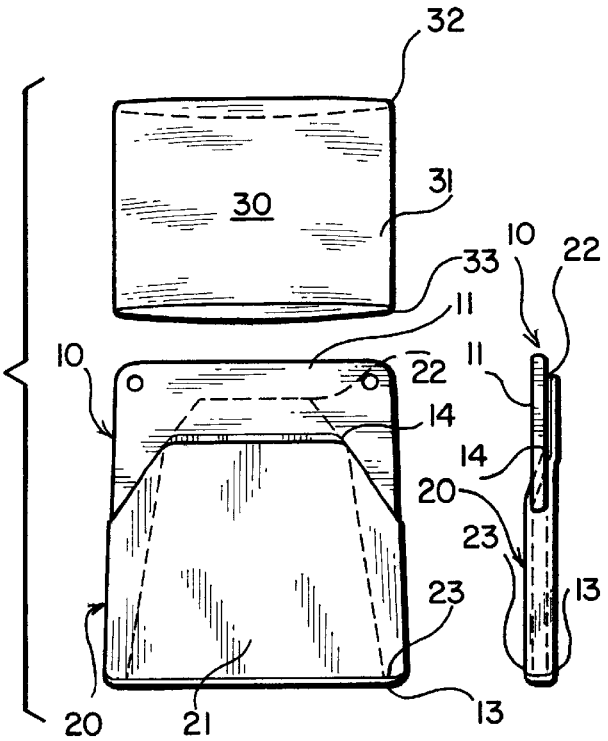

In FIG. 2/9 The inside sleeve 20 is stretched in place to envelop the U frame 10, so that the double edge line 23, is pulled tight across the fork ends 13; the opposite ends 22 are not tightly stretched.

These narrower ends 22 are tucked under the cross-member 11, along bottom line 14, so that the swimmer's foot can be slid along the cross-member surface 11 without interference from the edges of the inside sleeve. This position of the two flaps also distinguishes the bottom of the fin body from the top.

The function of the inside sleeve 20 is as a double layered resilient cradle surface 21 for the forward portion of the foot, and as the propulsion edges 23 against the water.

Figure 3:
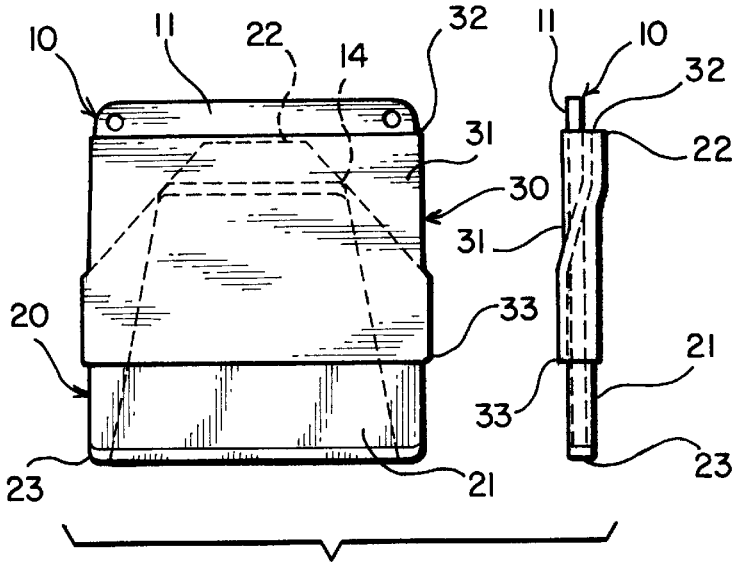

In FIG. 3/9 the outside sleeve 30 is stretched and in place over the U frame 10, and the inside sleeve 20, and this complete assembly is called the swim fin body.

The swimmer's foot is inserted under the outside sleeve surface 31 along edge line 32, whereby the foot is held firmly cushioned upon the top surface 21 of the inside sleeve 20. The flap ends 22 are kept tight against the underside surface of the cross-member 11 by the tension of the outside sleeve 30, along the underside of line 32. Depending on the foot size the toes may, or may not, protrude beyond edge line 33.

This configuration has the inside sleeve as a resilient cradle 21 for the forward portion of the foot, and the edges 23 as propulsion edges to the water; whereas the outside sleeve forms the tensioned pocket for the foot, and holds the loose ends of the inside sleeve 22 in place under the cross-member 11.

Figure 4:
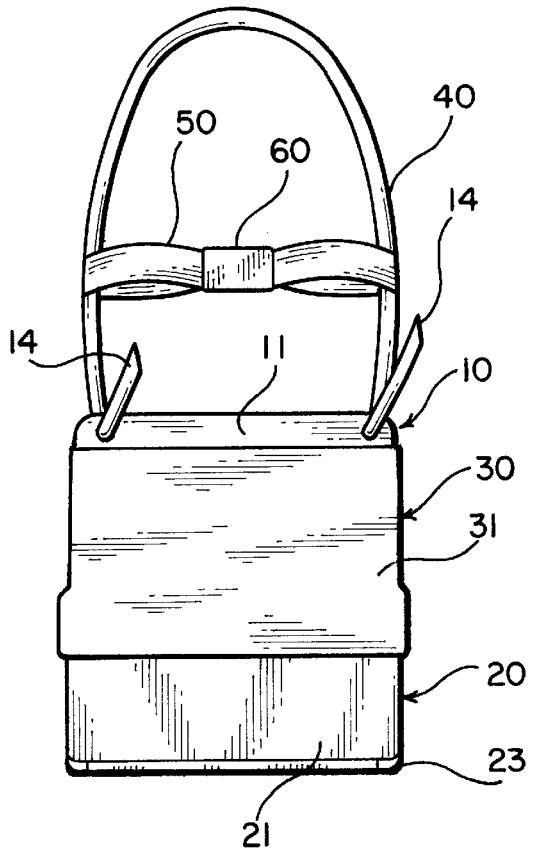

FIG. 4/9 has the arrangement of the three attachment components attached to the swim fin body, whereby the rubber tubing is 40, the rubber band is 50, and the rubber band retainer is 60. And accordingly the entire assembly is called the complete swim fin.

The rubber tubing 40 is a single length piece with limited flexibility, and is diagonally cut at each end 14, to facilitate threading through two holes 15, at the cross-member ends of surface 11, of U frame 10. These holes are a precise size to allow a tight pull in order to adjust the length of the rubber tubing 40, and the ends 14 point upward to indicate the top surface of the swim fm body.

The rubber band 50 is a cut piece from the same tubular extrusion material and the rubber retainer 60 is from a different extrusion. The retainer's only purpose is to secure the rubber band 50, in place around the rubber tubing 40.

Figure 5:
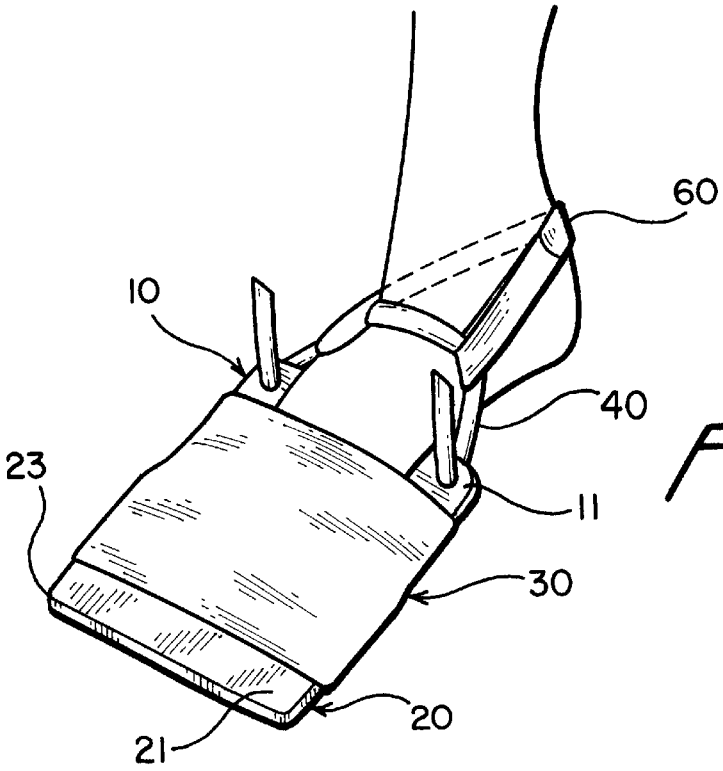

FIG. 5/9 has the rubber tubing 40 over the instep of the foot with the rubber band 50, and the retainer band 60 around the back of the heel.

Figure 6:
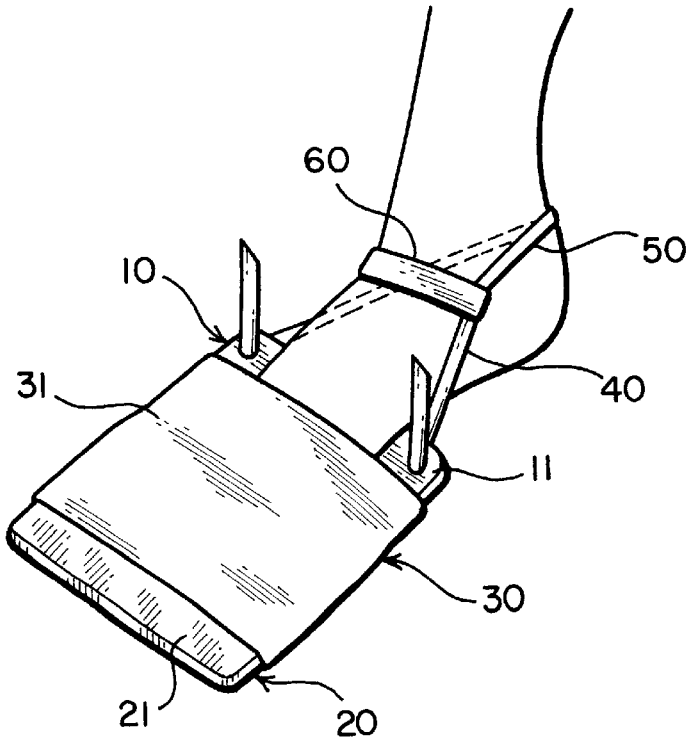

FIG. 6/9 has the rubber tubing 40 around the back of the heel, and the rubber band 50 with the retainer 60 over the instep.

Both methods are effective in holding the swim fin securely in place and the choice is a matter of personal comfort. The adjustment method is the same for either attachment choice.

Figure 7:
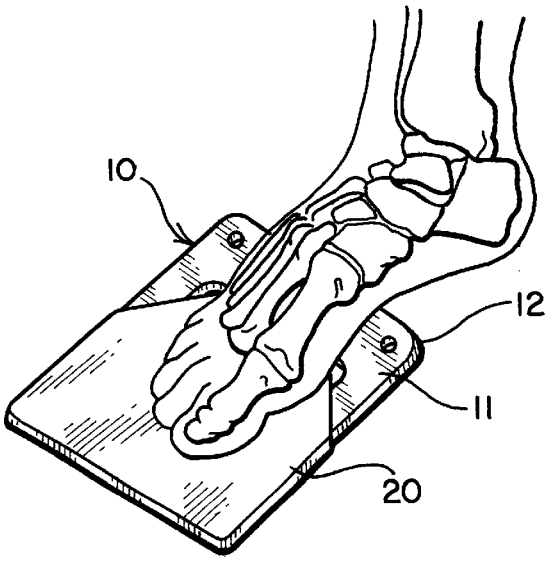

FIG. 7/9 has the U frame 10 correctly positioned with the fulcrum edge line 12, of the cross member 11 proximal to the metatarsal/cuniform joints.

The bone structure of the foot is shown in this drawing so that the mechanical function of the invention can be more fully appreciated. The outside sleeve 30 is intentionally omitted, but must be kept in mind as the tensioned pocket for the foot.

The anatomical illustration of the foot distinguishes the pivotal joints of the ankle, from the articulating joints of the foot distal to the ankle, so as to emphasize what constitutes the total longitudinal arch of the foot, and not just the range of motion of the ankle. Accordingly, this is a most important and unique feature of the invention as a stretching device. Whereby leveraging the foot from a forward position stretches the total longitudinal arch of the foot, which includes plantar flexion of the ankle.

Figure 8:
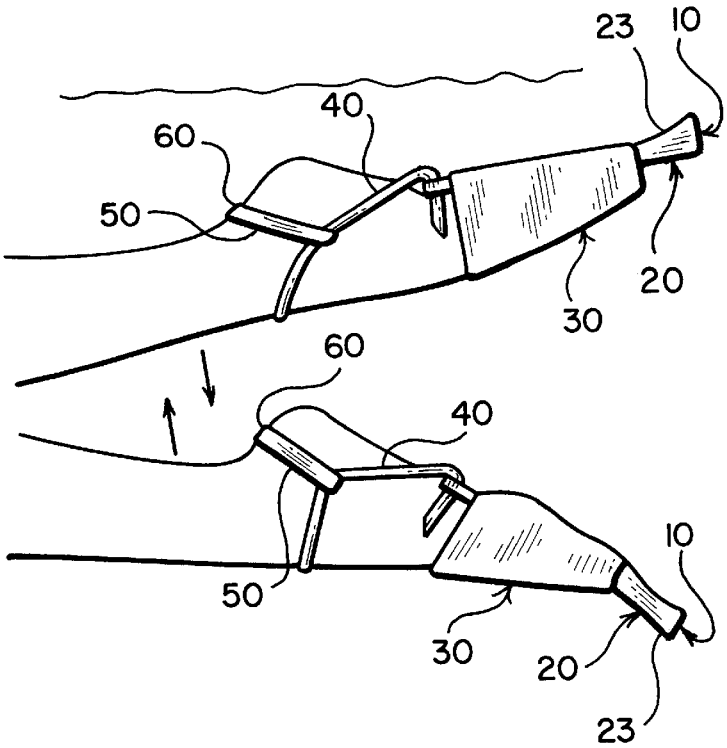

FIG. 8/9 is a motion study of the flutter kick whereby the downward motion of the right foot causes an arching of the foot by the lever action of the rigid U frame 10, with the fulcrum along line 12. Although there is some flaring of the inside sleeve along line 23, the U frame remains rigid.

The left foot shows the upward, or recovery motion, with no levering effect on the foot.

Figure 9:
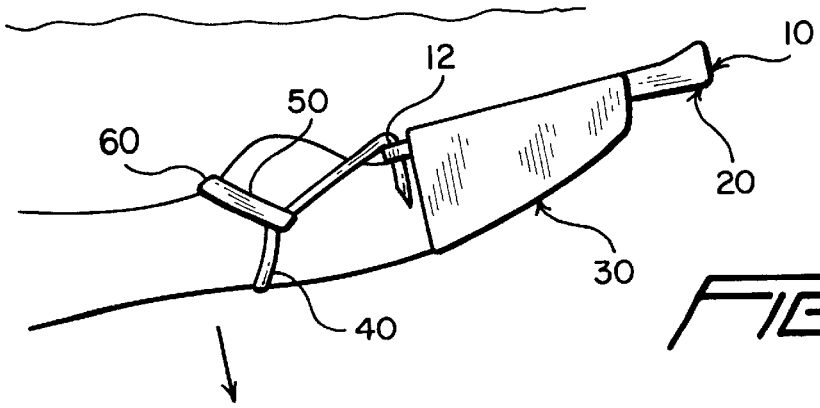

FIG. 9/9 is offered to show an appreciable increase in the arch of the foot that the invention is capable of accomplishing over a period of time as a stretching device. The angle of attack between the downward foot of FIG. 9 is almost 10 degrees more than that shown in FIG. 8. This amount of increase in the arch of the foot translates into a significantly faster swim time for the competitive swimmer.

I claim:

1. A swim fin for attachment to a swimmer's foot for the improvement of the fast flutter kick motions of speed swimming comprising:

a substantially U-shaped frame having a base and a pair of outwardly extending non-parallel forked legs, each having a first end joined to the base and an outer end at a predetermined distance therefrom wherein the distance between the legs is greater at the outer end than at the base:

a first flexible membrane having an upper portion and a lower portion each having outer edges joined together to form an envelope for insertion of the U-shaped frame base, said frame legs engaging and stretching the membrane edges in a taught relationship to provide an edge to scull water and wherein the envelope provides a resilient cradle for the foot:

a second flexible membrane has an aperture extending therethrough, said first flexible membrane being removable mounted within said second membrane with the forward portion of the first membrane extending outwardly from the second membrane: and, means mounted to the base of the U-shaped frame to engage and maintain a swimmer's foot within the membranes with the arch of said foot positioned over the base of the frame member.

2. A swim fin for attachment to a swimmer'foot for the improvement of the fast flutter kick motions of speed swimming in accordance with claim 1 wherein:

the U-shaped frame includes two spaced apertures: and, the mounting means comprises three elastic loops wherein a first loop includes a first end fitting tightly through one hole in the frame and a second end fitting tightly through the other hole in the frame, and an intermediate portion which fits over the swimmer's heel and second and third loops extending crosswise between the intermediate portion of the first loop secure the first loop about the foot.

3. A swim fin for attachment to a swimmer's foot for the improvement of the first flutter kick motions of speed swimming in accordance with claim 1 wherein:

the U-shaped frame is rigid and exerts a levered force to a fulcrum line across the width of the bottom of the foot that is proximal to the metatarsal and cuneiform joints to stretch the range of the motion of the ankle and the articulating joints distal to the ankle.

4. A swim fin for attachment to a swimmer's foot for the improvement of the last flutter kick motions of speed swimming in accordance with claim 1 wherein:

the flexible membranes enclose the forward portion of the foot to provide a short length to the fin, such that said short length, forward position of the foot and non-flexing frame react quickly to the action of the flutter kick.

5. A swim fin for attachment to a swimmer's foot for the improvement of the fast flutter kick motions of speed swimming wherein:

a U-shaped frame comprising a thin flat rigid plastic member having a base and a pair of spaced non-parallel legs extending outwardly from the base;

a circular rubber inside sleeve having open sides and a width formed by said sides which is less than the space between the frame legs, said sleeve enclosing the U-shape frame as a double surface closure, having one end taught between the legs and the other end forming a double flap with a diagonal shape that is tucked under the base;

a second circular outside rubber sleeve of the same width as the inside sleeve but having a shorter length, said sleeve being mounted over the inside sleeve and U-shaped frame located therein such that the outside sleeve holds the foot firmly in place on top of the inside sleeve; and, mounting means securing the U-shaped frame to the foot.

6. A swim fin for attachment to a swimmer's foot for the improvement of the last flutter kick motions of speed swimming in accordance with claim 5 wherein:

the mounting means comprises a length of rubber tubing, a first rubber hand and a smaller second rubber band wherein the smaller rubber band is positioned to encircle the larger rubber band to form a bow tie shape, or two open loops and through which the rubber tubing is threaded to form its own loop, said rubber tubing being adjustably secured to the frame.

7. A swim fin for attachment to a swimmer's foot for the improvement of the fast flutter kick motions of speed swimming in accordance with claim 1 wherein:

the foot is inserted over the rubber tubing and under the rubber bands placing the tubing around the back of the heel with the bands over the top of the foot.

8. A swim fin tor attachment to a swimmer's foot for the improvement of the fast flutter kick motions of speed swimming in accordance with claim 1 wherein:

the first flexible membrane includes a forward portion having the upper and lower portions forming an envelope and a rear portion having upper and lower portions and having upper and lower side edges extending inwardly from the outer edges of the forward portion to a predetermined point and then transversely to join with the edges of the other side, said rear upper and lower portions forming an open flap.

9. A swim fin for attachment to a swimmer's foot for the improvement of the fast flutter kick motions of speed swimming in accordance with claim 8 wherein:

the transverse edges of the rear portion are insertable beneath the base of the U-shaped frame.

10. A swim fin for attachment to a swimmer's foot for the improvement of the last flutter kick motions of speed swimming in accordance with claim 8 wherein:

the U-shaped frame comprises a flat polypropylene plastic member.

* * * * *